US007539323B2

(12) United States Patent
Funahashi et al.

(10) Patent No.: US 7,539,323 B2
(45) Date of Patent: May 26, 2009

(54) SPEAKER

(75) Inventors: Osamu Funahashi, Osaka (JP); Seiichi Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 305 days.

(21) Appl. No.: 10/590,966

(22) PCT Filed: Feb. 21, 2006

(86) PCT No.: PCT/JP2006/303024

§ 371 (c)(1),
(2), (4) Date: Aug. 29, 2006

(87) PCT Pub. No.: WO2006/098117

PCT Pub. Date: Sep. 21, 2006

(65) Prior Publication Data

US 2008/0240488 A1 Oct. 2, 2008

(30) Foreign Application Priority Data

Mar. 15, 2005 (JP) ..... 2005-072535

(51) Int. Cl.
*H04R 25/00* (2006.01)

(52) U.S. Cl. ..... 381/398; 381/403; 381/404

(58) Field of Classification Search ..... 381/396, 381/398, 403, 404, 405, 407, 423–425, 431–433; 181/171–173, 163–165
See application file for complete search history.

(56) References Cited

U.S. PATENT DOCUMENTS

| | | | | |
|---|---|---|---|---|
| 6,031,925 | A * | 2/2000 | Shteyn | 381/401 |
| 7,209,570 | B2 * | 4/2007 | Funahashi et al. | 381/398 |
| 7,324,659 | B2 * | 1/2008 | Funahashi et al. | 381/398 |
| 2005/0201588 | A1 | 9/2005 | Funahashi et al. | |

FOREIGN PATENT DOCUMENTS

| | | |
|---|---|---|
| JP | 57-109697 | 7/1982 |
| JP | 4-192800 | 7/1992 |
| JP | 11-150791 | 6/1999 |
| JP | 2004-221691 | 8/2004 |
| JP | 2004-304512 | 10/2004 |

* cited by examiner

*Primary Examiner*—Huyen D Le
(74) *Attorney, Agent, or Firm*—Wenderoth, Lind & Ponack, L.L.P.

(57) ABSTRACT

Disclosed is a speaker configured to reduce or eliminate distortions when a diaphragm thereof vertically moves in sound reproduction and which can be downsized. This speaker includes: a cylindrical frame having a bottom face and an open top; a magnetic circuit disposed on a inner bottom face of the frame; a voice coil having a coil portion thereof disposed in a magnetic gap of the magnetic circuit; the diaphragm disposed in an opening of the frame, and fixed to the voice coil along an inner periphery thereof, and to the frame via a first edge along an outer periphery thereof; and a support fixed to the diaphragm on the side of the magnetic circuit at one end and to the vicinity of the magnetic circuit via the second edge on the other end. The first edge is substantially analogous to the second edge in shape with respect to the boundary therebetween.

11 Claims, 2 Drawing Sheets

SPEAKER

This application is a U.S. national phase application of PCT International Application PCT/JP2006/303024.

TECHNICAL FIELD

The present invention relates to a speaker for use in various kinds of electronic equipment.

BACKGROUND ART

Conventional speakers have the following general structures. One of the conventional speakers includes a frame, a magnetic circuit, a voice coil, a diaphragm, and a damper. The frame has a cylindrical shape with a bottom face and an open top. The magnetic circuit is placed on the inner bottom face of the frame. A coil portion of the voice coil is disposed in a magnetic gap of this magnetic circuit. The diaphragm is disposed in the opening of the frame so that the inner periphery thereof is fixed to the voice coil and the outer periphery thereof is fixed to the frame via an edge. The damper is fixed to the voice coil at one end thereof, and to the frame at the other end thereof. The speaker with this conventional structure is disclosed in FIG. 8 of Japanese Patent Unexamined Publication No. H11-150791.

However, the conventional speaker has the edge along the outer periphery of the diaphragm, and the damper is fixed to the voice coil, which is fixed to the diaphragm. In these types of speakers, the load imposed from the edge and damper in the upward and downward directions when the diaphragm moves vertically is not substantially constant. As a result, distortions can occur in reproduction of sounds. Additionally, because both edge and damper are fixed to the frame, downsizing of the speaker is generally difficult.

SUMMARY OF THE INVENTION

The present invention provides a speaker that prevents occurrence of distortions when the diaphragm vertically moves in sound reproduction. Additionally, the present invention provides a speaker that can be downsized.

A speaker of the present invention includes a frame, a magnetic circuit, a voice coil, a diaphragm, and a support. The frame has a cylindrical shape with a bottom face and an open top. The magnetic circuit is placed on the inner bottom face of the frame. A coil portion of the voice coil is disposed in a magnetic gap of this magnetic circuit. The diaphragm is disposed in an opening of the frame so that the inner periphery thereof is fixed to the voice coil and the outer periphery thereof is fixed to the frame via a first edge. The support is fixed to the diaphragm on the magnetic circuit side at one end of the support, and to the vicinity of the magnetic circuit via a second edge at the other end. The first edge is substantially analogous to the second edge in shape with respect to the boundary between the first and second edges.

With this structure that has no damper and has the diaphragm supported near the magnetic circuit via a support, the first edge along the outer periphery of the diaphragm is substantially analogous in shape to the second edge at the other end of the support, with respect to the boundary between the first and second edges. For this reason, the load imposed when the diaphragm vertically moves is substantially constant, and thus distortions in sound reproduction are unlikely to occur. Further, the second edge at the other end of the support is fixed to the vicinity of the magnetic circuit. This structure allows downsizing more easily than fixing the second edge to the frame.

REFERENCE MARKS IN THE DRAWINGS

Figure 1:
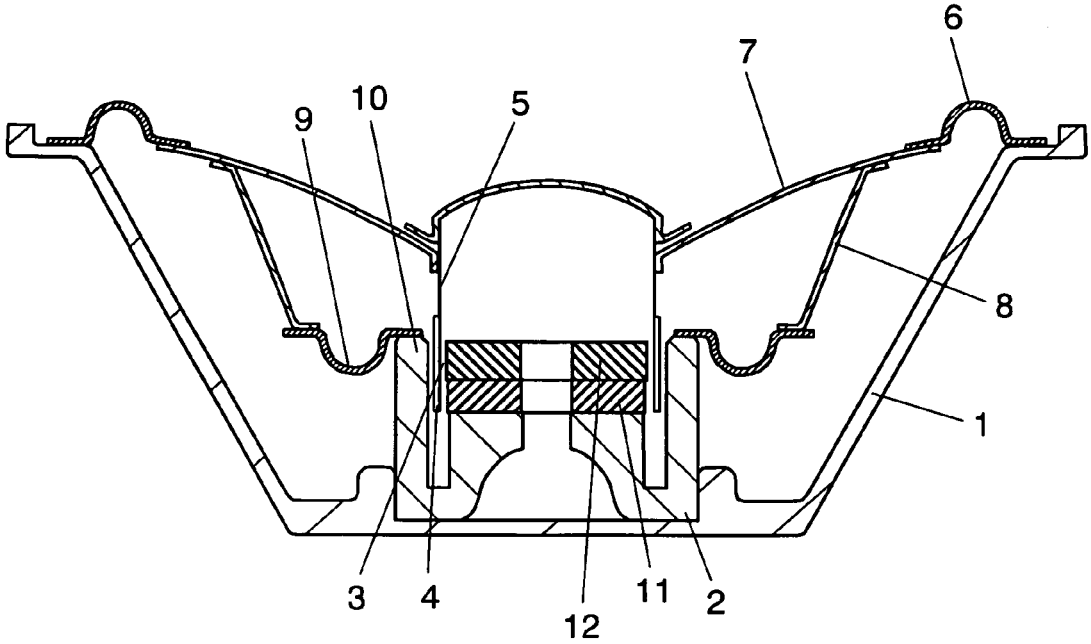
FIG. 1 is a sectional view illustrating a structure of a speaker in accordance with a first exemplary embodiment of the present invention.

1 Frame
2 Magnetic circuit
3 Magnetic gap
4 Coil portion
5 Voice coil
6 First edge
7 Diaphragm
8 Support
9 Second edge
10 Yoke
11 Magnet
12 Plate
13, 14 Fixed part

DETAILED DESCRIPTION OF PREFERRED EMBODIMENTS

Hereinafter, a description is provided of exemplary embodiments of the present invention with reference to the accompanying drawings.

First Exemplary Embodiment

Figure 2:
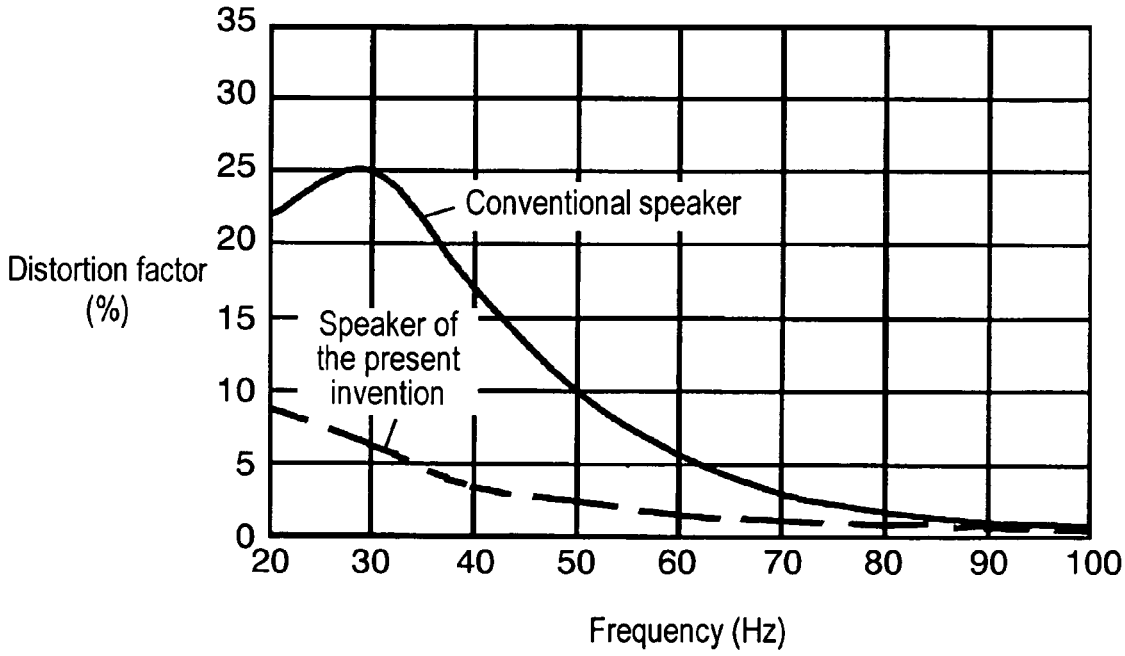
FIG. 2 shows characteristics of harmonic distortion factors of the speaker in accordance with the exemplary embodiment.

FIG. 1 is a sectional view illustrating a structure of a speaker in accordance with the first exemplary embodiment of the present invention. FIG. 2 shows characteristics of harmonic distortion factors of the speaker of the exemplary embodiment. In FIG. 1, the speaker includes frame 1, magnetic circuit 2, voice coil 5, diaphragm 7, and support 8. Frame 1 has a cylindrical shape with a bottom face and an open top (shaped like a bowl). Magnetic circuit 2 is disposed on the inner bottom face of frame 1.

Voice coil 5 has a cylindrical shape so that coil portion 4 thereof is disposed in magnetic gap 3 of magnetic circuit 2. Diaphragm 7 is disposed in the opening of frame 1. The diaphragm has an internal and an external side and a donut shape so that the inner periphery thereof is fixed to voice coil 5, and the outer periphery thereof is fixed to frame 1 via first edge 6. Support 8 is fixed to diaphragm 7 on the side of magnetic circuit 2 (i.e., the internal side of the diaphram) at one end of the support, and to the upper end of yoke 10 of magnetic circuit 2 via second edge 9 at the other end. Magnetic circuit 2 is made of yoke 10, magnetic circuit 11, and plate 12.

Both of first edge 6 and second edge 9 are formed of a rubber material. With reference to FIG. 1, first edge 6 has an upwardly-projecting circular section, and second edge 9 has a downwardly-projecting circular section. First edge 6 is substantially analogous to second edge 9 in shape with respect to the boundary therebetween (i.e., first edge 6 and second edge 9 have substantially the same shape). First edge 6 can be formed to have a downwardly-projecting circular section, and second edge 9 can be formed to have an upwardly-projecting circular section, in FIG. 1.

When sound electric signals are passed through coil portion 4 of voice coil 5 in the above structure, the influence of the magnetic flux in magnetic gap 3 allows voice coil 5 to vertically move diaphragm 7. Thus, sounds are reproduced. At this time, as described above, both of first edge 6 and second edge 9 are made of the same material, e.g. rubber materials. First edge 6 has an upwardly-projecting circular section, and second edge 9 has a downwardly-projecting circular section.

With this structure, first edge 6 is substantially analogous to second edge 9 in shape with respect to the boundary therebetween, and first edge 6 and second edge 9 are made of the same material. For this reason, the load imposed when diaphragm 7 vertically moves is the same even in the upward motion and downward motion of diaphragm 7. As a result, distortions are unlikely to be caused by asymmetrical upward and downward motions in sound reproduction.

As shown by "conventional speaker" in FIG. 2, the load imposed by the edge and damper of the conventional speaker when the diaphragm vertically moves is not substantially constant in the upward and downward directions. As a result, particularly at low frequencies, large distortions occur. In contrast, for a speaker of this exemplary embodiment, as similarly shown by "speaker of the present invention", the load imposed when diaphragm 7 vertically moves is the same in the upward and downward motions of diaphragm 7. Thus, it can be understood that even at low frequencies, occurrence of harmonic distortions are considerably reduced in comparison with the conventional speaker.

If second edge 9 at the other end of support 8 is fixed to frame 1 on the outer peripheral side of magnetic circuit 2 like the conventional structure, the frame must be enlarged so that the second edge is movable. However, because second edge 9 at the other end of support 8 is fixed to the end of yoke 10 in this exemplary embodiment, a movable range of second edge 9 is sufficiently ensured on the outer peripheral side of yoke 10 even without frame 1 enlarged. As a result, the speaker can easily be downsized.

Second Exemplary Embodiment

Figure 3:
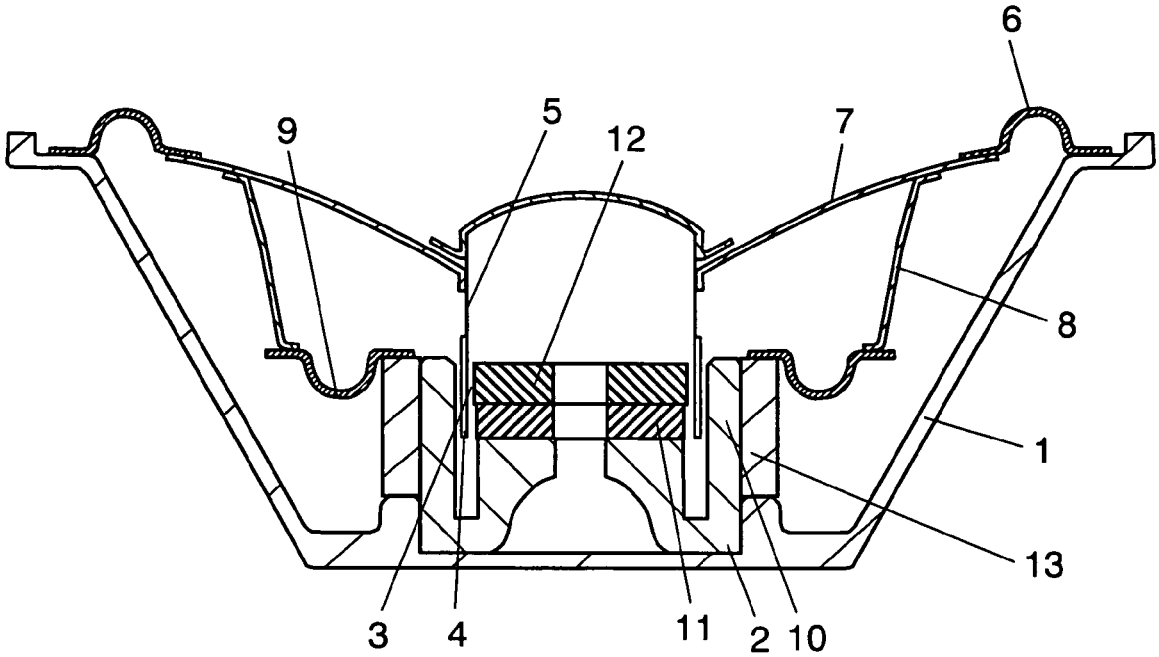
FIG. 3 is a sectional view illustrating a structure of a speaker in accordance with a second exemplary embodiment of the present invention.

FIG. 3 is a sectional view illustrating a structure of a speaker in accordance with the second exemplary embodiment of the present invention. In FIG. 3, same elements used in FIG. 1 are denoted with the same reference marks and descriptions thereof are omitted. The speaker of this exemplary embodiment includes cylindrical fixed part 13 along the outer periphery of yoke 10. Second edge 9 is fixed to the upper end of fixed part 13. This structure can prevent the inflow of an adhesive into magnetic gap 3 when second edge 9 is bonded with the adhesive, and ensure the distance from the second edge to magnetic gap 3 and a bonding space at the same time.

As described above, similar to the first exemplary embodiment, first edge 6 is substantially analogous to second edge 9 in shape with respect to the boundary therebetween. Thus, the load imposed when diaphragm 7 vertically moves is the same in the upward and downward motions of diaphragm 7. As a result, distortions are unlikely to occur in sound reproduction. As for the harmonic distortion factors of this embodiment, substantially similar characteristics to those of the first exemplary embodiment shown in FIG. 2 can be obtained. Further, because second edge 9 at the other end of support 8 is fixed to fixed part 13 provided along the outer periphery of yoke 10, a movable range of second edge 9 is sufficiently ensured on the outer peripheral side of fixed part 13 even without the frame enlarged. As a result, the speaker can easily be downsized.

Similarly to a third exemplary embodiment, which will be described later, when the distance from the bottom face of frame 1 to the side end face of second edge 9 of fixed part 13 is smaller than the distance from the bottom face to the end of yoke 10 constituting magnetic circuit 2, the inflow of the adhesive into magnetic gap 3 can more securely be prevented.

Third Exemplary Embodiment

Figure 4:
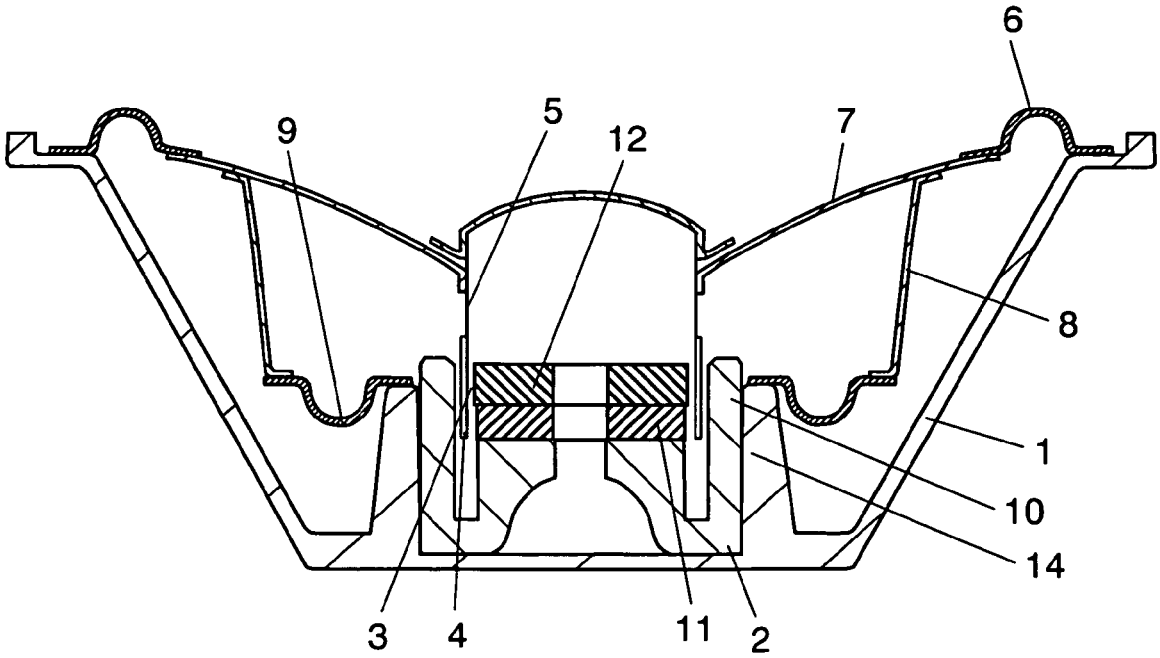
FIG. 4 is a sectional view illustrating a structure of a speaker in accordance with a third exemplary embodiment of the present invention.

FIG. 4 is a sectional view illustrating a structure of a speaker in accordance with the third exemplary embodiment of the present invention. In FIG. 4, same elements used in FIG. 1 are denoted with the same reference marks and descriptions thereof are omitted. The speaker of this exemplary embodiment includes cylindrical fixed part 14 integral with frame 1 along the outer periphery of yoke 10, and second edge 9 is fixed to the upper end of fixed part 14. The distance from the bottom face of frame 1 to the side end face of second edge 9 of fixed part 14 is smaller than the distance from the bottom face to the end of yoke 10 constituting magnetic circuit 2. In other words, the height of fixed part 14 is smaller than the end of yoke 10 in the direction toward the bottom face of frame 1.

With this structure, the height of fixed part 14 to which second edge 9 is bonded is smaller than the height of yoke 10. This structure allows prevention or reduction of the inflow of an adhesive into magnetic gap 3 when second edge 9 is bonded with the adhesive, and ensures the distance from the second edge to magnetic gap 3 is maintained, along with an adhesive space. Further, this embodiment has an advantage of reducing the number of components and costs, in comparison with the second exemplary embodiment. The height of fixed part 13 of the second exemplary embodiment can be reduced similar to the fixed part of the third exemplary embodiment.

As described above, similar to the first and second exemplary embodiments, first edge 6 is substantially analogous to second edge 9 in shape with respect to the boundary therebetween. Thus, the load imposed when diaphragm 7 vertically moves is the same in the upward and downward motions of diaphragm 7. As a result, distortions are unlikely to occur in sound reproduction. As for the harmonic distortion factors of this embodiment, substantially similar characteristics to those of the first exemplary embodiment shown in FIG. 2 can be obtained. Further, because second edge 9 at the other end of support 8 is fixed to fixed part 13 provided along the outer periphery of yoke 10, a movable range of second edge 9 is sufficiently ensured on the outer peripheral side of fixed part 13 even without the frame enlarged. As a result, the speaker can easily be downsized.

INDUSTRIAL APPLICABILITY

As described above, a speaker of the present invention is unlikely to cause distortions when a diaphragm thereof vertically moves in sound reproduction and can be downsized. Thus, the invention is useful as a speaker, for example, for use in various kinds of electronic equipment.

The invention claimed is:

1. A speaker comprising:

a frame having a bottom face and an open top;

a magnetic circuit disposed on the bottom face of the frame;

a voice coil having a coil portion thereof disposed in a magnetic gap of the magnetic circuit;

a diaphragm disposed in an opening of the frame, and fixed to the voice coil along an inner periphery thereof, and fixed to the frame via a first edge along an outer periphery thereof; and a support having a first end fixed to a magnetic circuit side of the diaphragm, and a second end fixed to the magnetic circuit via a second edge;

wherein the first edge has substantially the same shape as the second edge.

2. The speaker of claim 1, wherein the support is fixed to an end of the magnetic circuit via the second edge.

3. The speaker of claim 1, wherein the support is fixed, via the second edge, to a fixed part provided along an outer periphery of the magnetic circuit.

4. The speaker of claim 3, wherein the fixed part is integrally formed with the frame.

5. The speaker of claim 3, wherein a distance from the bottom face of the frame to a side end face of the second edge of the fixed part is smaller than a distance from the bottom face to an end of the magnetic circuit.

6. The speaker of claim 1, wherein the first edge and the second edge are made of substantially a same material.

7. The speaker of claim 1, wherein the frame is cylindrical.

8. A speaker, comprising:

a frame having a bottom face and an open top;

a magnetic circuit disposed on the bottom face of the frame;

a voice coil having a coil portion thereof disposed in magnetic gap of the magnetic circuit;

a diaphragm being disposed in an opening of the frame, and fixed to the voice coil along an inner periphery thereof, and fixed to the frame via a first edge along an outer periphery thereof; and a support having a first end fixed to a magnetic circuit side of the diaphragm, and a second end fixed at to a vicinity of the magnetic circuit via a second edge;

wherein the first edge has substantially the same shape as the second edge; and wherein the support is fixed, via the second edge, to a fixed part provided along an outer periphery of the magnetic circuit.

9. The speaker of claim 8, wherein the fixed part is integrally formed with the frame.

10. The speaker of claim 8, wherein a distance from the bottom face of the frame to a side end face of the second edge of the fixed part is smaller than a distance from the bottom face to an end of the magnetic circuit.

11. The speaker of claim 8, wherein the frame is cylindrical.

* * * * *